US006524159B1

(12) United States Patent
Kawarizadeh

(10) Patent No.: US 6,524,159 B1
(45) Date of Patent: Feb. 25, 2003

(54) INTELLIGENT TOY

(76) Inventor: Behrouz Kawarizadeh, 5829 Robert Paul Place, Columbus, OH (US) 43231

( * ) Notice: Subject to any disclaimer, the term of this patent is extended or adjusted under 35 U.S.C. 154(b) by 0 days.

(21) Appl. No.: 09/644,431

(22) Filed: Aug. 23, 2000

Related U.S. Application Data

(60) Provisional application No. 60/150,299, filed on Aug. 23, 1999, and provisional application No. 60/223,687, filed on Aug. 8, 2000.

(51) Int. Cl.[7] ..... A63H 5/00
(52) U.S. Cl. ..... 446/397; 446/484
(58) Field of Search ..... 446/91, 175, 301, 446/81, 98, 118, 397, 404, 477, 484, 485, 491; 455/462; 463/43, 44, 45

(56) References Cited

U.S. PATENT DOCUMENTS 4,095,791 A * 6/1978 Smith et al.
4,156,928 A * 5/1979 Inose et al.
4,359,222 A * 11/1982 Smith et al.
4,640,987 A * 2/1987 Tsukada et al.
5,655,945 A * 8/1997 Jani ..... 446/175
5,873,765 A * 2/1999 Rifkin et al. ..... 446/175 X
6,171,168 B1 * 1/2001 Jessop ..... 446/397 X
6,179,682 B1 * 1/2001 Plain et al. ..... 446/397 X
6,227,931 B1 * 5/2001 Shackelford ..... 446/268

* cited by examiner

*Primary Examiner*—John A. Ricci
(74) *Attorney, Agent, or Firm*—James R. Eley, Esq.; Thompson Hine LLP

(57) ABSTRACT

An object that includes a sound chip coupled to a receiving and audio (R/A) device. The sound chip may preferably be either static or dynamic in regards to its recording capabilities in the field, i.e., outside the manufacturing environment. Through this coupling data stored on the sound chip is played back through an audio system in the R/A device. This stored data is correlated to a type of the object, e.g., a person, a color, a shape, a machine, an animal, a planet, a trading card, etc. Optionally, the R/A device can be coupled to a computer, and the stored data in the object can control the computer such that the type of object initiates playback through the computer of either data stored in the computer or related data on the Internet or Intranet. Also, an alternative R/A device has a rotating section so that the object can be seen by more people in an area. Further, the object can have LED circuits to illuminate predetermined parts and motors to move predetermined parts.

18 Claims, 8 Drawing Sheets

INTELLIGENT TOY

RELATED APPLICATION

This application is a continuation of U.S. Provisional Application Ser. Nos. 60/150,299 and 60/223,687, filed Aug. 23, 1999 and Aug. 8, 2000, respectively, which are incorporated herein by reference.

BACKGROUND OF THE INVENTION

This invention is directed towards toys with audio and visible outputs. More particularly, the invention relates to toys that output sounds and make movements correlating to characteristics of the toy.

For many years parents and instructors have used toys to educate children, as well as entertain them. These toys allow children to learn about the color, letter, animal, machine, etc., that the toy resembles through use of an audio output. Generally, this is done though use of an audio device that plays a recorded message to a child after any well known type of activation switch is triggered. This message can be recorded directly in the toy or in a receiving device that is attached to the toy. In more advanced toys, the toy or receiving device may be able to play a plurality of sounds relating to interchangeable toys, which further expands the toy's usefulness. Unfortunately, these more advanced toys are still limited in the variety of sounds they can output.

SUMMARY OF THE INVENTION

According to the present invention, an object that includes a sound chip, which may preferably be either a static or dynamic sound chip in regards to its recording capability, is coupled to a receiving and audio (R/A) device. Through this coupling data stored on the sound chip is played back through an audio system in the R/A device. This stored data is correlated to a type of the object, e.g., a person, a color, a shape, a machine, an animal, a planet, a trading card, etc. Optionally, the R/A device can be coupled to a computer, and the stored data in the object can control the computer such that the type of object initiates playback through the computer of either data stored in the computer or related data on the Internet or Intranet. Also, an alternative R/A device has a rotating section so that the object can be seen by more observers.

Other embodiments of the present invention are directed to educational and/or entertaining childrens' toys having perceivable outputs. In addition to having audio output, the invention can be configured to have visually perceivable indicators, and moving or vibrating components. In preferred embodiments, the toy itself contains no power means, but rather derives its power from a corresponding base portion in which it is placed for activation. Unlike conventional toys, the toys according to preferred embodiments of the present invention contain the pre-programmed instruction set that is utilized to generate audio, visual or mechanical responses when activated subsequent to being coupled to a base.

BRIEF DESCRIPTION OF THE DRAWINGS

Further features of the present invention will become apparent to those skilled in the art to which the present invention relates from reading the following specification with reference to the accompanying drawings, in which.

DESCRIPTION OF THE PREFERRED EMBODIMENT(S)

Figure 1:
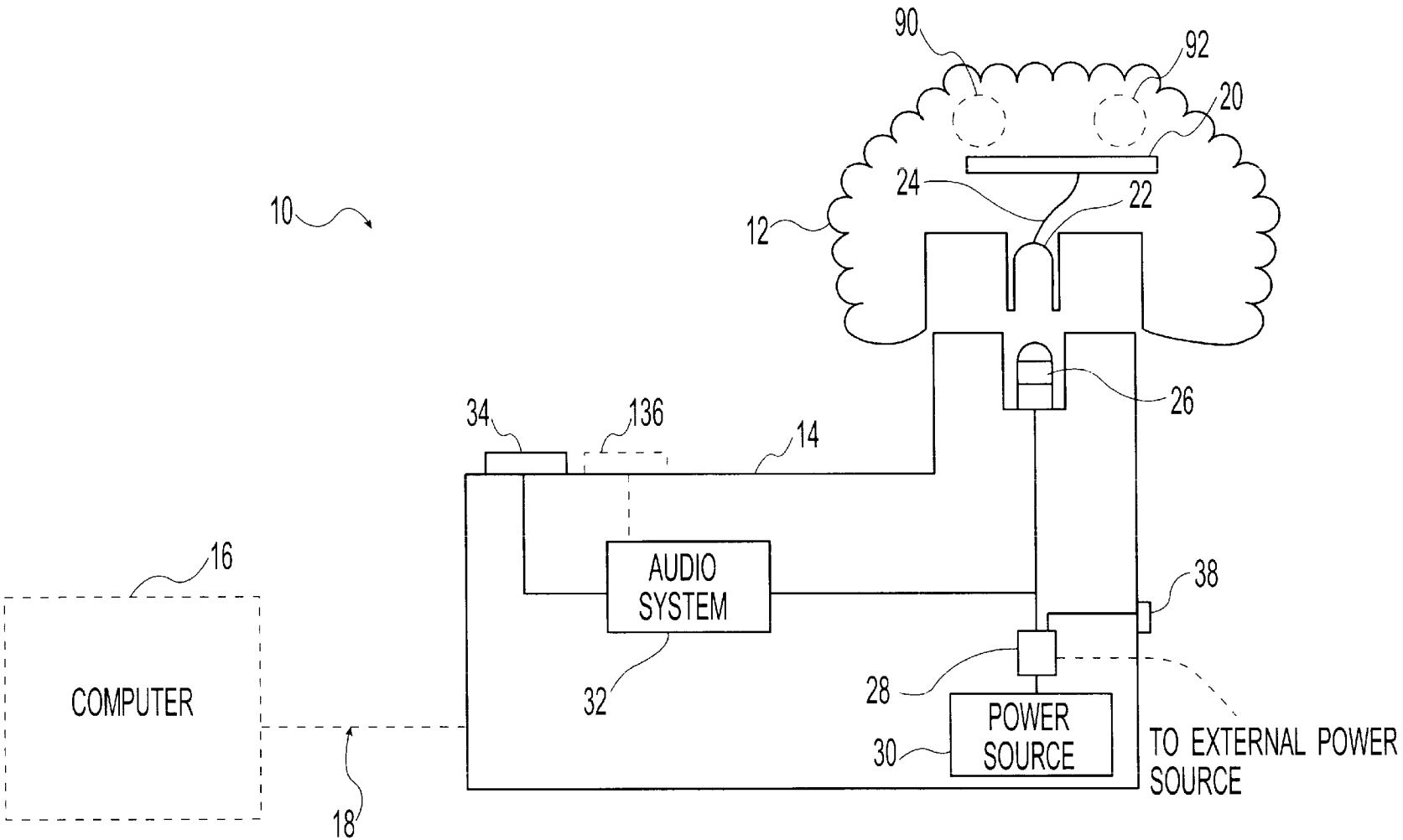
FIG. 1 shows an object and receiving/audio (R/A) device according to a first preferred embodiment of the present invention.

FIG. 1 shows a system 10 according to a first preferred embodiment of the present invention. The system 10 includes an object 12, preferably a toy of some variety, and a receiving/audio (R/A) device 14. In alternative configurations, the system 10 is coupled to a computer 16, as is shown by the dashed line 18. According to the present invention, the object 12 is coupled to the R/A device 14 to power the object 12 so that the system 10 generates audio sounds and perceivable movements correlating to the object 12.

With continuing reference to FIG. 1, the object 12 includes a static sound chip 20 coupled to an object connector 22 via a coupling device 24. The object connector 22 securely locks onto a R/A device connector 26. As is best seen in FIG. 2, the R/A device connector 26 includes a positive section (+/Vcc) 26A, an audio/signal section (A/SIG) 26B, and a negative/ground section (–/GND) 26C.

The R/A device 14 further includes a controller 28, a power source 30, and an audio system 32. The audio system 32 is coupled to a volume control device 34. The controller 28 is coupled to a controller switch 38 that allows the system 10 to run off either the power source 30, or optionally an external power source (not shown) in a known manner.

Figure 2A:
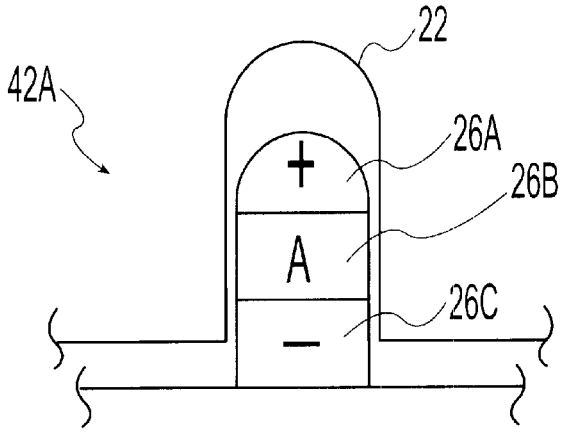
FIGS. 2A–2G are detailed views of alternative preferred embodiments of a connector device used in the system of FIG. 1.
Figure 2B:
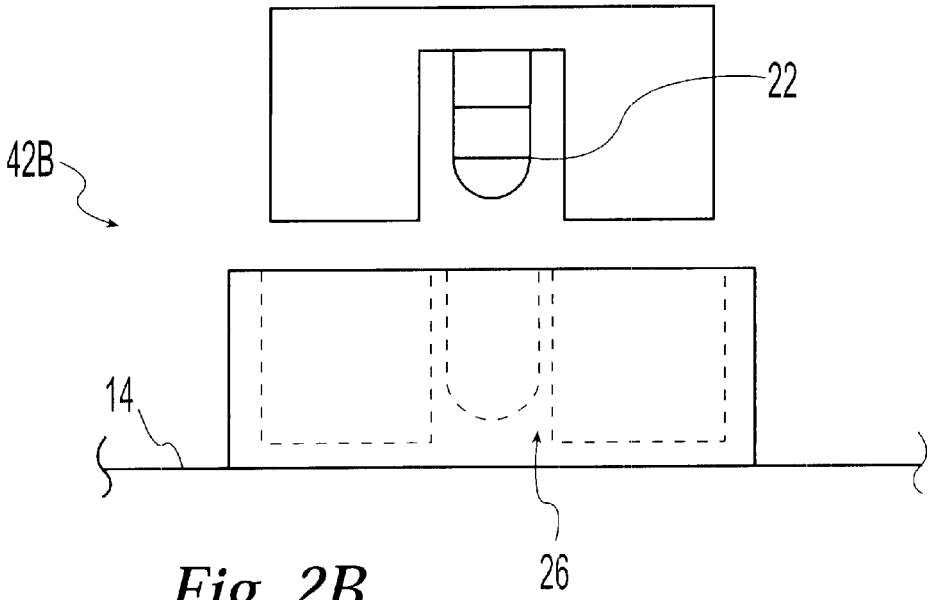
Figure 2C:
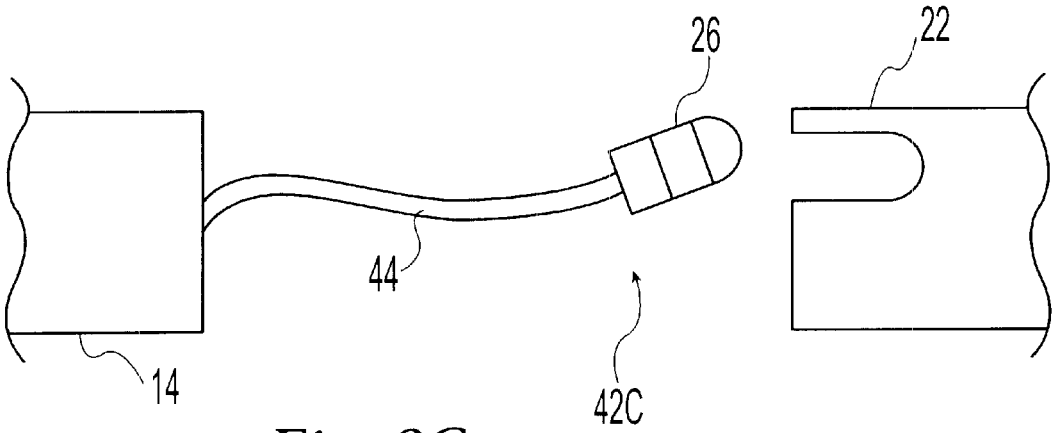

In FIGS. 1–2C, preferred alternative configurations of connector device systems 42A–42C according to alternative preferred embodiments of the present invention are shown. The connector devices 42A and 42C include the object connector 22 configured as a female-type connector and the R/A device connector 26 configured as a male-type connector, where device 42B has the opposite configuration. As is shown in FIG. 2B, the connectors 22 and 26 in the connector device 42B can be reversed so that the object connector 22 is a male-type connector and the R/A device connector 26 is a female-type connector without affecting the functionality of the system 10. Further, as shown in FIG. 2C, the R/A device connector 26 can be coupled to the R/A device 14 through a coupling device 44, preferably an insulated wire.

Figure 2D:
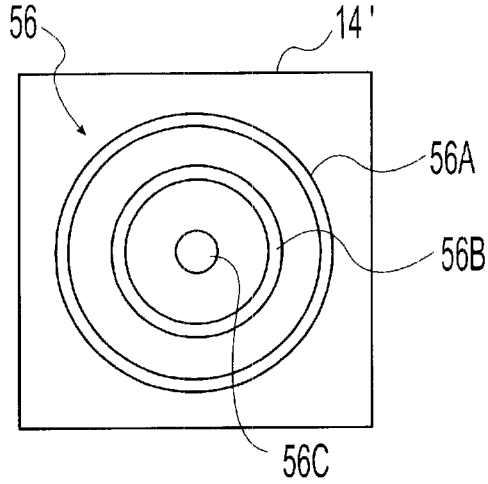

Turning to FIG. 2D a ring-type contact arrangement 56 is shown. There it is shown that a base 14' is provided with concentric rings for Vcc 56A and SIG 56B and a GND contact 56C. This type of connection configuration is particularly well suited for those applications where there is rotation between the object (not shown) and its base 14', as is described in detail below with reference to FIGS. 6A–6B and 7A–7C.

Figure 2E:
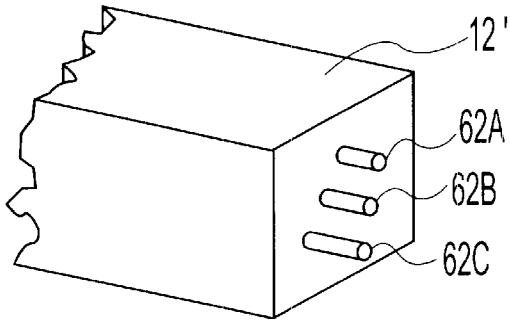

However, this concentric connection arrangement 56 is not limited to rotating applications. The corresponding connection arrangement on the object 12' may be configured as depicted in FIG. 2E, where each connection component, Vcc 62A, SIG 62B, and GND 62C, has a spring-biased plunger providing the contact point. Note that it is generally preferable in a circuit of this sort to make GND 62C contact first. Therefore, the GND contact plunger 62C in FIG. 2E is shown to be somewhat longer than Vcc 62A or SIG 62B, which enables the GND contact 62C to engage its corresponding GND contact in the base (not shown) before the other two contacts are made.

Figure 2F:
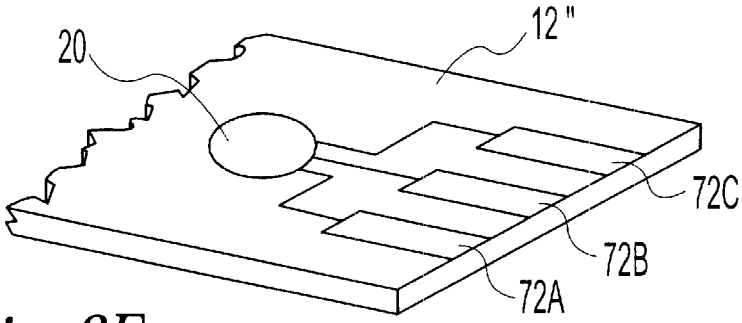

Yet another alternative preferred configuration of the connector device in the first preferred embodiment of the present invention relates to an object that is preferably a card enclosure that can house such additional objects as photos, trading cards, postage stamps, coins, business cards or other, similar encaseable, flattened objects. Referring now to FIG. 2F, a card type object 12" is shown having edge connector type contacts 72. Once again, connection points between the toy 12" and its corresponding base (not shown) are Vcc 72A, SIG 72C, and GND 72B. As an alternative to a stationary base similar to 14, the card toy 12" can be mated to a corresponding female connector, attached to a cable for interfacing to a computer, power source or other external interfacing device.

Figure 2G:
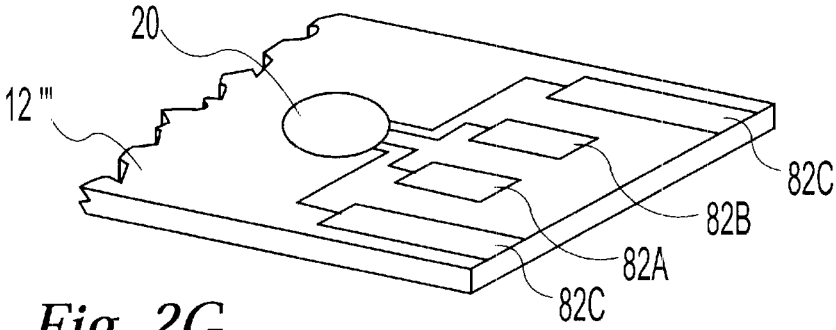

Referring additionally to FIG. 2G, an alternative configuration 82 of the edge connector 72 is shown. As can be clearly seen, edge connector 82 includes multiple GND conductors 82B that are also longer than the Vcc 82A and SIG 82B conductors. In this fashion, regardless of how the card object 12'" is matted with its corresponding base (not shown) or cable connector (not shown), the GND connection 82B is established first. Additionally, the card object 12"" may be provided even greater over-voltage protection by adding additional GND contacts 82B on the reverse side of the card object 12'". In such configuration the card object 12'" would be considered "hot swappable" without concern for damage to the onboard electronic circuitry.

Turning back to the operation of the system 10 of FIG. 1, in the preferred embodiments, the sound generated by the R/A device 14 is based on the shape, color, form, or any other parameter of the object 12. The form of the object 12 preferably could be a person, a machine, e.g., car, plane, boat, etc., an animal (presently in existence or extinct), a card-like object, or any other form. Accordingly, a user, e.g., a child, can attach a plurality of interchangeable objects 12 to learn about any number of topics, where different objects 12 relating to different ages of children could allow for continued use of the system 10. In the first embodiment, each object 12 includes specific preset data in the static sound chip 20, which is output through the connection of object 12 with R/A device 14.

By sealing the static sound chip 20 in object 12, the object 12 can be used in any environment, e.g., a bath tub, outdoor water supply, dirt, mud, etc., without effecting the function of the system 10. After the user is finished playing with the object 12 separately, the object 12 is cleaned off and connected to the R/A device 14, and the system 10 operates. Also, through use of a recessed male-type connector in several of the configurations the system 10 is safe for even young children since the likelihood of injury from the male-type connector coming in contact with a vital organ is greatly reduced.

Figure 3A:
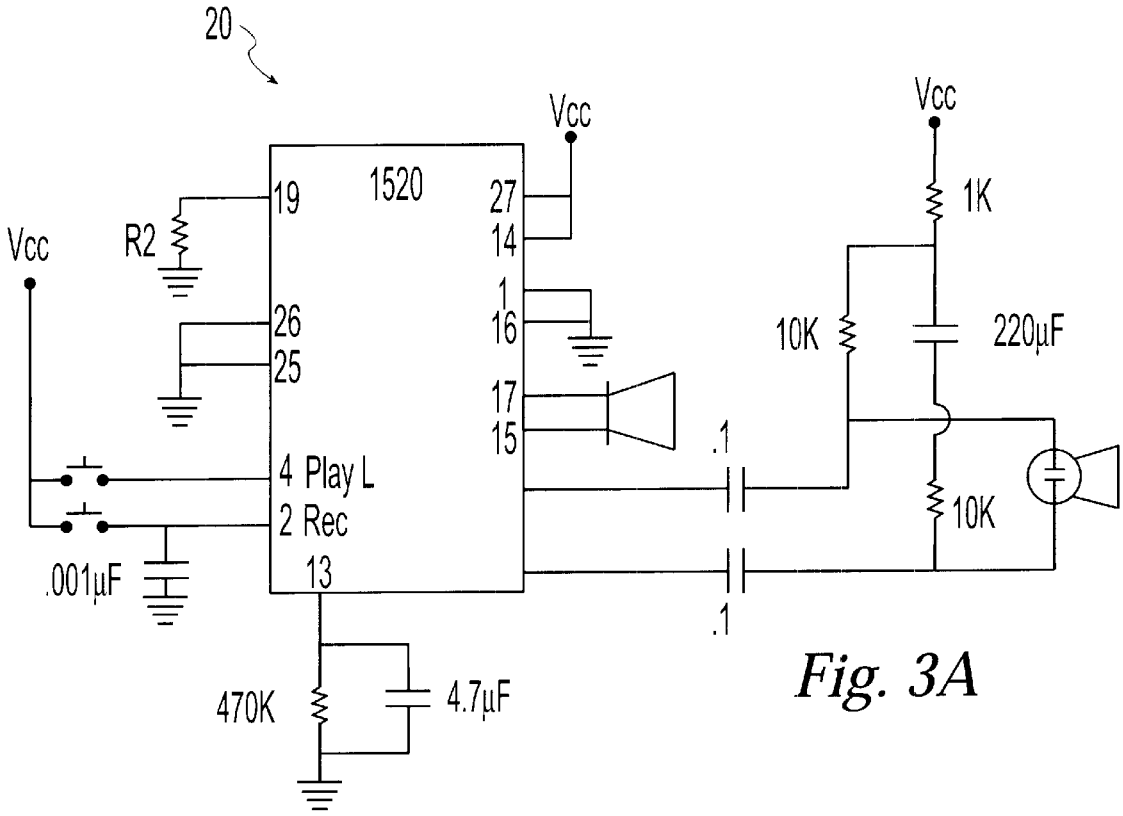
FIG. 3A is a circuit diagram of a programming stage of a static sound chip system according to the first preferred embodiment as seen in FIGS. 1–2G.
Figure 3B:
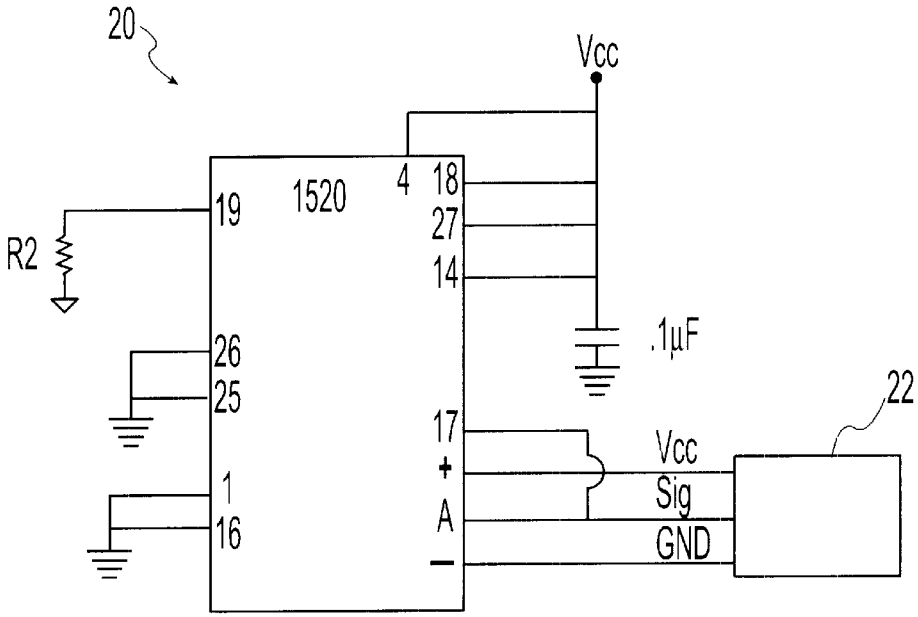
FIG. 3B is a circuit diagram of a operation stage of the static sound chip in FIG. 3A.

With reference to FIGS. 3A and 3B, a more detailed schematic circuit view of a programming and operation stage of the static sound chip 20 is shown. As seen in FIG. 3A, the chip 20 is shown as configured during a programming stage in a factory. In this configuration of FIG. 3A, all the information relating to a predetermined object is stored in the chip 20. Once this programming stage is complete, the chip 20 becomes a static information chip, only replaying what was recorded. After the programming is completed, the chip 20 is configured in object 12 as shown in FIG. 3B. Thus, in this configuration of FIG. 3B, the chip 20 is activated when connector 22 is coupled to connector 26 (not shown), and the chip 20 is powered through a power source associated with base 14.

Figure 4A:
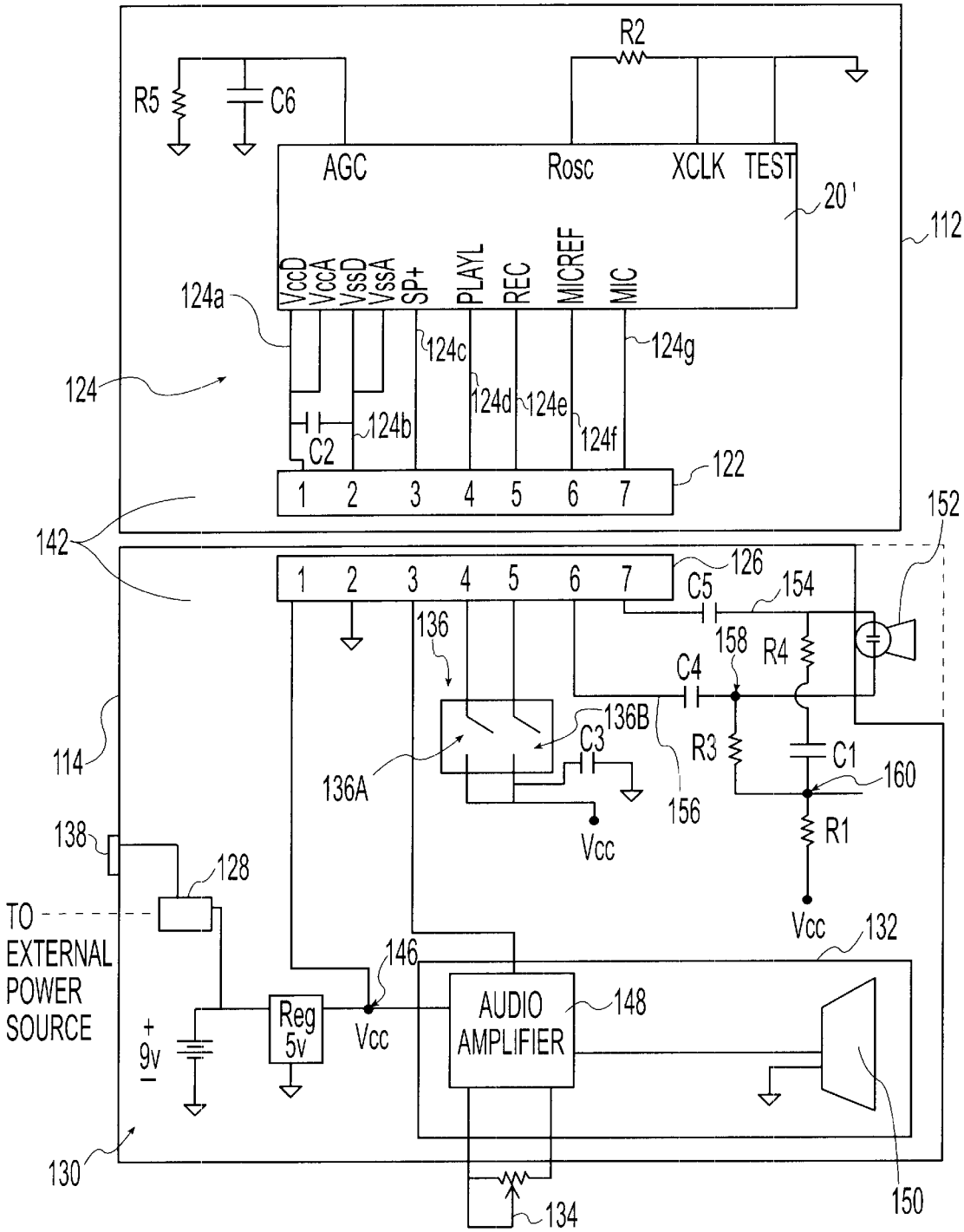
FIGS. 4A–4B are circuit diagrams showing dynamic sound chip systems according to a second preferred embodiment of the present invention.

Turing now to FIG. 4A, a detailed view of the circuit and connections of the a dynamic sound chip 20' according to a second preferred embodiment of the present invention is shown. In this preferred embodiment, the sound chip 20' is configured as an ISD1520 ChipCorder (chip manufactured by ISD) of San Jose, Calif. and the object connector 122 includes seven (7) pins. In this configuration, the AGC pin is coupled to ground through resistor R5, which is preferably 470 KΩ, and capacitor C6, which is preferably 4.7 μF. Pin Rosc is coupled to ground through a resistor R2, which is preferably 100 KΩ, and Xclk and Test pins are coupled directly to ground. A VCCD pin is coupled to a VCCA pin and the object connector pin 1, and a VSSD pin is coupled to a VSSA pin and the object connector pin 2. A capacitor C2, which is preferably 0.1 μF, couples a transmission element 124*a* to a transmission element 124*b*. Further, SP+, PLAYL, REC, MICR REF, and MIC pins are coupled directly to the objector connector pins 3–7, respectfully, via transmission elements 124*c* through 124*g*, respectively.

With continuing reference to FIG. 4A, the connections between R/A device connector 126 and the R/A device 114 elements are shown in detail. There are seven (7) pins in the R/A device connector 126 that correspond to the object connector pins 1–7 of the object connector 122. As seen in FIG. 4A, R/A device connector pin 1 is coupled to a node 146 that outputs voltage Vcc from the power source 130 and couples the audio system 132 to the power supply. The audio system 132 includes an audio amplifier 148, which is also coupled to R/A device connector pin 3 in connector 126, and a speaker 150. The audio amplifier 148, and in turn the volume output from speaker 150, is controlled through the volume control device 134, which is preferably a potentiometer.

During use, a user can switch between a recording and listening mode when through the audio switch 136 that is coupled to R/A device connector pins 4 and 5, where the audio switch 136 includes a PLAYL switch 136*a* and a REC switch 136*b*, where only one switch can be closed at a time. A preferred placement of the audio switch 136 is shown in phantom as dashed lines in FIG. 1. Although a system including the configuration in FIG. 4 would be slightly different than FIG. 1, the preferred placement of the audio switch 136 is shown for reference. When the PLAYL switch is closed, the preset recording on the chip 20' is played through the R/A device 114. On the other hand, when the REC switch 136*b* is closed, the dynamic sound chip 20' receives and stores input audio signals via an internal microphone 152. Hence, this is the dynamic recording function of the dynamic sound chip 20'. Optionally, the microphone 152 can be positioned externally from the R/A device 114, as is shown with the dotted line. The REC switch 136*b* is also coupled to ground through a capacitor C3, which is preferably 0.001 $\mu$F.

With continuing reference to FIG. 4A, R/A device connector pins 6–7 are coupled to the microphone 152 through capacitors C4 and C5, respectively. Preferably, C4 and C5 are 0.1 $\mu$F. A resistor R4, which is preferably 10 KΩ, is coupled across lines 154 and 156 that include the capacitors C4 and C5, respectively. The resistor R4 is connected in series with a capacitor C1 and a resistor R1, in that order, where the resistor R1 is coupled to voltage Vcc. Preferably, the capacitor C1 is 220 $\mu$F and the resistor R1 is 1 KΩ. Further, a resistor R3, which is preferably 10 KΩ coupled on one end to a node 158 that connects capacitors C4 and microphone 152, and on an opposite end to a node 160 that connects capacitor C1 and resistor R1.

Figure 4B:
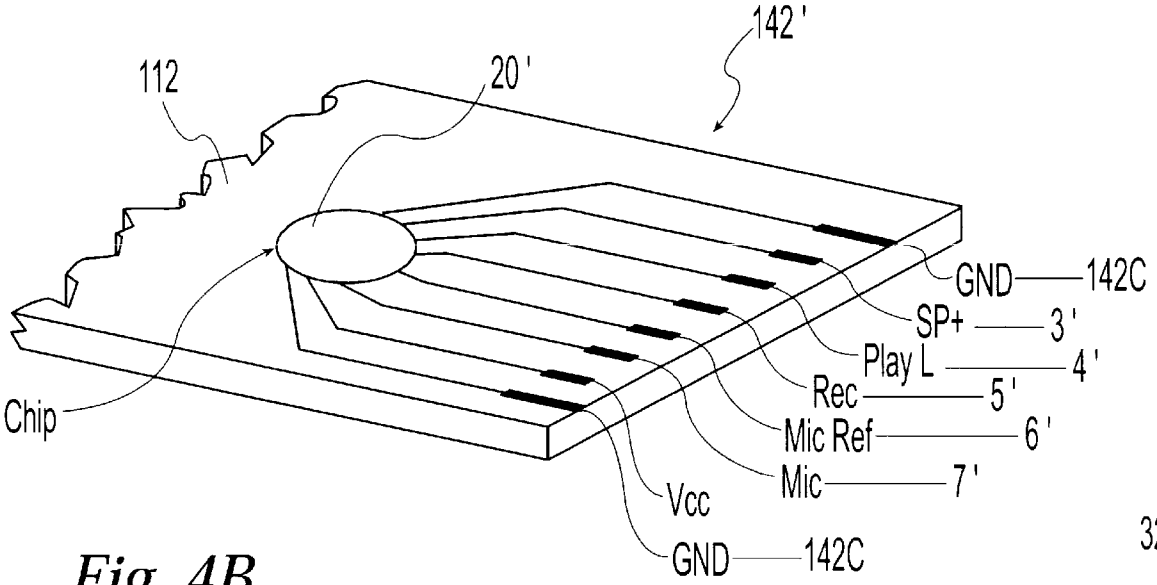

FIG. 4B shows the dynamic sound chip 20' with a alternative configuration for its connector 142'. This connector 142' is an edge connector, similar to 72 and 82 above, and includes an additional ground contact compared to connector 142. By including the two ground contacts, whose lengths are longer than the other contacts, this connector 142' has a similar ground contact configuration, and thus similar advantages, as the connector 82 in FIG. 2G.

The sizes, shapes and configurations of the invention can vary greatly. Therefore, numerous arrangements of alternative preferred connector contacts have been devised in addition to the ones disclosed above.

Through the configuration of either the first or second embodiment shown in FIGS. 1 and 4, respectively, when one of the preferred configurations of the object 12 is connected to the R/A device 14/114 this connection initiates operation of system 10/10'. During operation, if switch 36/136 is positioned for play, data stored in the chip 20/20' is output through audio device 32/132.

When the dynamic chip 20' in the second embodiment is utilized, if switch 136 is positioned for recording, input from microphone 152 is stored in the dynamic sound chip 20' to be played in the future. Accordingly, system 10' is a dynamic system.

Figure 5:
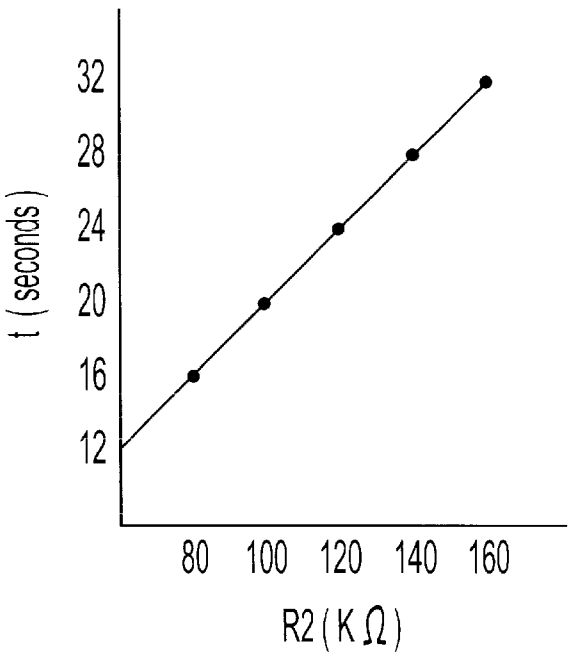
FIG. 5 is a graph that illustrates time duration of playback of a message through the system of FIG. 3A–B and 4A–B.

The duration of playback of the stored data for both static sound chip 20 and dynamic sound chip 20' is controlled through the value of resistor R2, as is illustrated by the graph in FIG. 5. The higher the resistance value of R2, the longer the static sound chip 20 and the dynamic sound chip 20' transmit information to the R/A device 14/114 for play back.

In other alternative arrangements, a computer 16 can be coupled to the R/A device 14/114. During operation of the system 10/10' in this arrangement, the computer outputs audio signals based on the information stored in chip 20/20'. It can be appreciated that the chip 20/20' could also store control signals, such that information either stored in the computer, or an attached database, e.g., the Internet or Intranet, can be played back for the user upon locking of the object 12 and the R/A device 14/114 through any one of the alternative configuration of connector 42/142.

Again turning to FIG. 1, an alternative configuration of the object 12 can include an illuminating device 90 (shown in phantom by dashed lines), which is coupled between the VCC and ground. This device 90 can be, for example, one or more colored LEDs, incandescent bulbs, strobe bulbs, or the like, which will allow a visual as well as audio attraction to the object 12. For example, the object 12 could be a land vehicle with flashing head lights 90 or a bird's eye (see FIG. 7C and discussion below).

FIG. 1 also shows a mechanical section 92 in phantom.

Figure 6A:
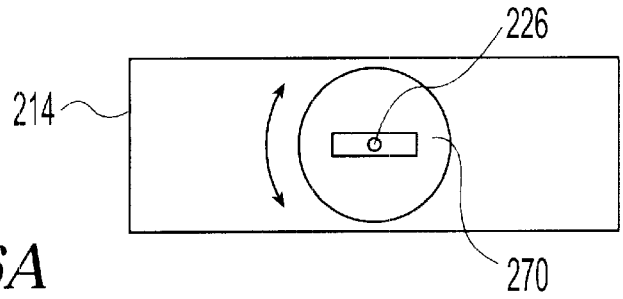
FIGS. 6A and 6B show a R/A device according to another preferred embodiment of the present invention.
Figure 6B:
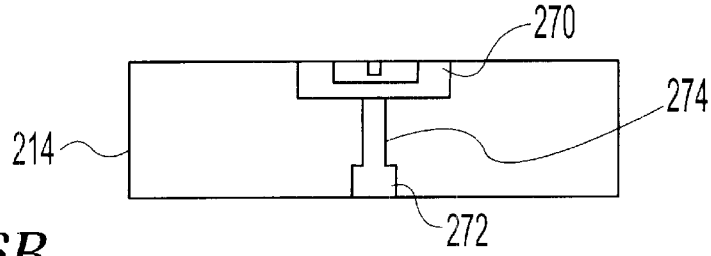

With reference to FIGS. 6A and 6B, a R/A device 214 according to a another preferred embodiment of the present invention is shown. The R/A device 214 includes a circular section 270 that is coupled to a motor 272 through a shaft 274. In this configuration, the object (not shown) can rotate in either direction, which allows for an increased field of view of the object during its use by a user.

Figure 7A:
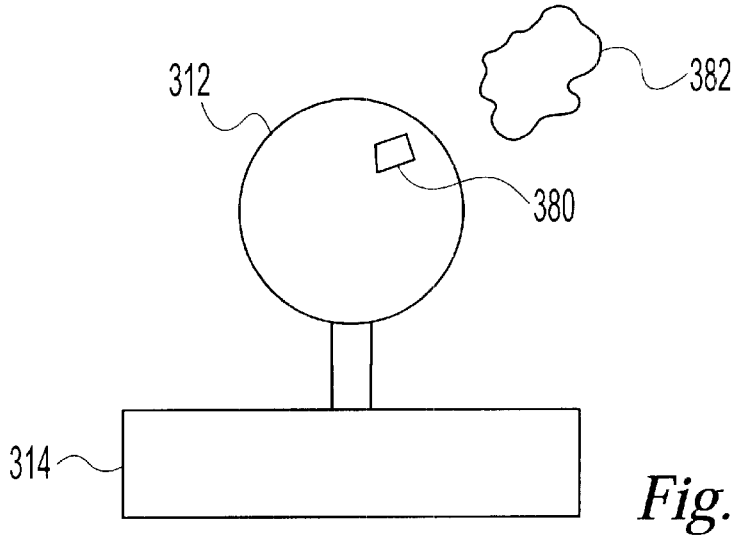
FIGS. 7A–7C show objects according to alternative other preferred embodiments of the present invention.

Turing to FIG. 7A, an object 312 according to another preferred embodiment is shown. In this configuration the object 312 has a sensor 380, for example and acoustic or optical sensor, that can pick up a signal transmitted from a second object 382 that comes within a certain proximity of the object 312. In one preferred embodiment, the object 312 is a planet and the second object 382 is an asteroid. Then, the asteroid 382 is detected by the sensor 380, and a predetermined audio output is generated by the R/A device 314 corresponding with the asteroid 382.

Figure 7B:
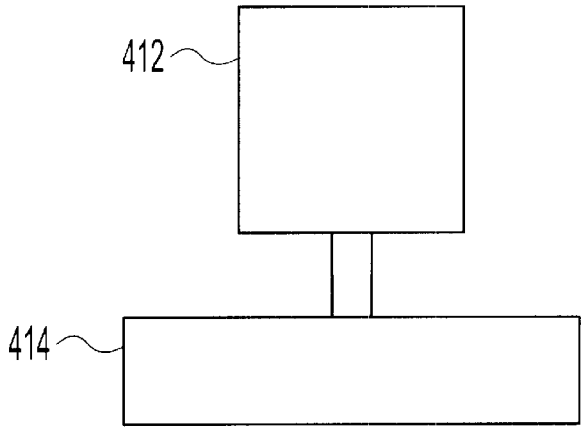

In FIG. 7B, an object 412 according to another preferred embodiment is shown. In this embodiment, object 412 is preferably any type of card, e.g., a playing card, game card, trading card, sports card, collectors card, or the like. After coupling the object 412 to the R/A device 414, all the information relating to this card 412 is played through the R/A device 414. For example, this could be statistics on an athlete or information on a movie character.

Figure 7C:
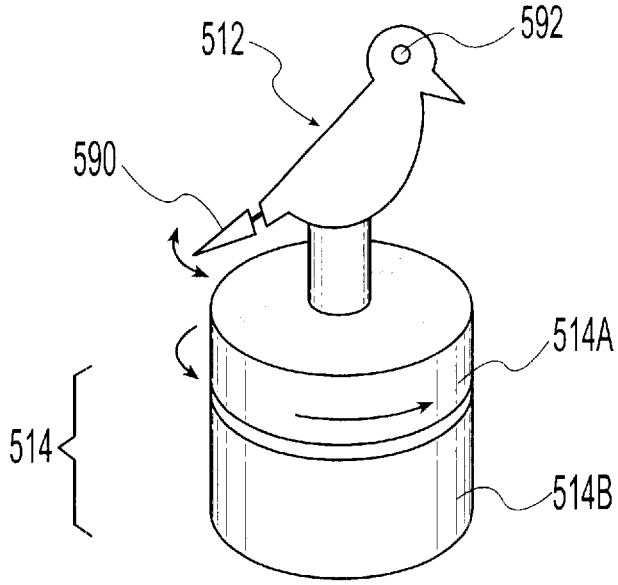

Referring to FIG. 7C, another object 512 is shown attached to a base 514, where the base includes a stationary base portion 514B and a rotatable base portion 514A, which can be a similar to the rotatable section on the R/A device 214 in FIGS. 6A–6B. The rotatable base portion 514A houses a motor (not shown), which enables the object 512 to rotate when coupled to the stationary base portion 514B. As described above in reference to the static 20 and dynamic 20' sound chips, the object 512 may contain programmed audio messages for playing when activated. In this alternative preferred embodiment, the object 512 can also include battery powered devices, such as small motors (see FIG. 8C) for moving character components, such as a bird's tail 590, and/or a LED 592 for illuminating any part of a bird 512, for example its eye.

The object 512 is also provided with a connector (not shown) that includes Vcc, GND, and SIG, as described above. Since the power is provided by the base 514 when the object 512 is coupled with corresponding connection points in the base 514, then other powered devices housed in the object 512, such as LEDs 592 or small motors (see FIG. 8C), can also be activated. Adding visual or mechanical activity to the object 512 along with audio activity provides additional stimulus for a user and keeps the user's attention for longer periods of time.

Figure 8A:
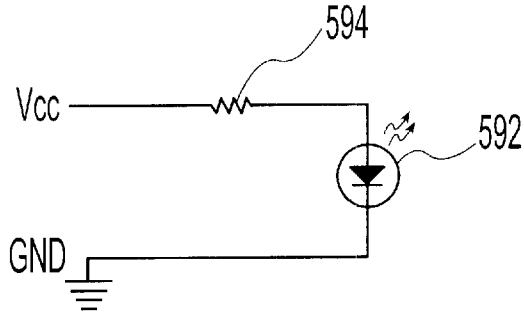
FIG. 8A is schematic circuit diagram of another preferred embodiment of the present invention that depicts a powered LED.
Figure 8B:
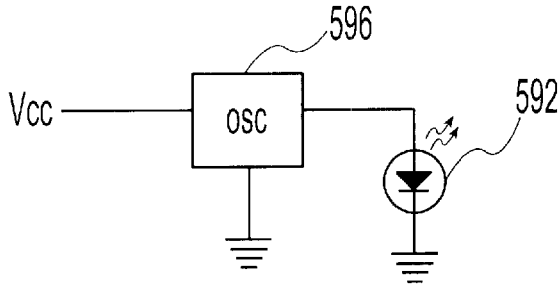
FIG. 8B is a schematic depicting another preferred embodiment of the present invention for conserving power that also depicts a powered LED.

FIG. 8A shows a preferred schematic of an LED circuit that can be contained within the object 512. Connections at Vcc and GND, when coupled with corresponding connections in the base 514, cause the LED/light 592 to be activated until power is removed. One concern is the drain on the battery (not shown) in base 514 that powers the object 512. FIG. 8B shows an alternative configuration wherein an oscillator 596 is employed by the LED powering circuit to conserve power. The oscillator 596 conserves power by altering the duty cycle of the Vcc power provided to the LED 592, in effect turning the LED 592 repeatedly on and off, with a noticeable visual affect.

Figure 8C:
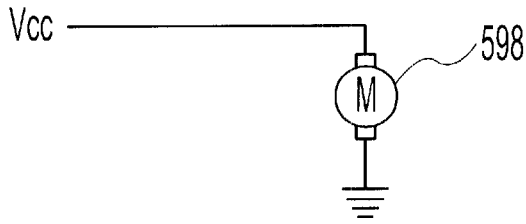
FIG. 8C is a schematic of another preferred embodiment of the present invention depicting a powered motor.

FIG. 8C shows a Vcc powered motor circuit that can also be housed within the bird's tail 590 of the object 512. As one may appreciate, the motor 598 may provide for reciprocating action of an object component, such as the moveable tail 590, for a spinning rotating action, a buzzing sound, a vibrating motion, or the like.

From the above description of the invention, those skilled in the art will perceive improvements, changes and modifications in the invention. Such improvements, changes and modifications within the skill of the art are intended to be covered.

I claim:

1. A system comprising:

a plurality of interchangeable visually detectable objects, each having a substantially different shape or bearing a likeness of a substantially different shaped object, and including a processor and a first coupling device, said processor being programmed with object specific information;

a base having an audio circuit with an output and including a second coupling matable to said first coupling device; and a power source coupled to the base for supplying power to the audio circuit and said processor within said objects when each of said objects and said base are coupled via said first and second coupling devices, wherein said object specific information is transformed into audio signals and transmitted through said audio output when each of said objects are coupled to said base.

2. The system according to claim 1, further comprising:

a visual section of the objects that allows for visual stimulation of a user subsequent to the objects being coupled to the base.

3. The system according to claim 1, further comprising:

a mechanical section of the objects that allows for mechanical stimulation of a user subsequent to the objects being coupled to the base.

4. The system according to claim 1, wherein:

the first coupling device is configured as a male coupling device; and the second coupling device is configured as a female coupling device.

5. The system according to claim 4, wherein:

the male coupling device is configured as a spring-biased male coupling device.

6. The system according to claim 1, wherein:

the first coupling device is configured as a female coupling device; and the second coupling device is configured as a male coupling device.

7. The system according to claim 1, wherein:

the first coupling device is configured as an edge connector coupling device.

8. The system according to claim 1, wherein:

the first coupling device is configured to include positive, ground, and signal sections; and the second coupling device is configured to include positive, ground, and signal sections.

9. The system according to claim 8, wherein:

the ground section is longer than the positive section and the signal section, such that the ground section contacts the second coupling device before the positive section and the signal section contact the second coupling device.

10. The system according to claim 8, wherein:

the first section includes a plurality of the ground section; and the second coupling device includes a plurality of the ground section.

11. The system according to claim 10, wherein the plurality of the ground section are longer than the positive section and the signal section, such that the plurality of the ground section contact the second coupling device before the positive section and the signal section contact the second coupling device.

12. The system according to claim 1, wherein:

the processor is configured as a dynamic recording processor during use.

13. The system according to claim 1, wherein:

the processor is configured as a static recording processor during use.

14. The system according to claim 1, wherein:

the base is configured to have first and second sections, the first section configured as a stationary section and the second section configured as a moving section.

15. The system according to claim 1, wherein:

each of the objects is configured as a toy.

16. The system according to claim 15, wherein:

the toy includes a sensor configured to sense when another object is proximate to the toy, such that the processor transmits predetermined signals to the base subsequent to the objects being coupled to the base when the another object is proximate the sensor.

17. The system according to claim 1, wherein:

the objects are configured as visually perceivable likenesses of a shaped object inserted within a carrier, wherein said object specific information is directed to the audio circuit from the processor and transmitted through said audio output subsequent to the objects being coupled to the base.

18. A system comprising:

a plurality of interchangeable visually detectable objects each having a substantially different shape or bearing the likeness of a substantially different object and including a processor programmed with object specific information and a first coupling device;

a base including an audio device and a second coupling device;

a power source coupled to the base that supplies power to the base and, subsequent to coupling of the first coupling device and the second coupling device, to the objects, such that subsequent to the objects receiving power, the processor transmits predetermined, object specific information signals to the audio device, which is configured to output audio signals from the base corresponding to the predetermined object specific information signals.

* * * * *